US007360646B2

(12) United States Patent
Sugiharto

(10) Patent No.: US 7,360,646 B2
(45) Date of Patent: Apr. 22, 2008

(54) 2-IN-1 CIGARETTES PACKAGING WITH A 'CLICK' OPENING SYSTEM AS CONTAINER FOR ALL KINDS OF CIGARETTES EQUIPPED WITH MATCHES AND STRIKING PAPER

(76) Inventor: Indra Muliadi Sugiharto, No. 19 Budisari III, Bandung (ID)

( * ) Notice: Subject to any disclaimer, the term of this patent is extended or adjusted under 35 U.S.C. 154(b) by 309 days.

(21) Appl. No.: 11/218,205

(22) Filed: Aug. 31, 2005

(65) Prior Publication Data

US 2006/0266662 A1 Nov. 30, 2006

(30) Foreign Application Priority Data

May 26, 2005 (ID) ..... S00200500070

(51) Int. Cl.
*A24F 15/00* (2006.01)

(52) U.S. Cl. ..... 206/86; 206/91; 206/268

(58) Field of Classification Search ..... 206/86, 206/91, 268, 271, 273; 229/160.1
See application file for complete search history.

(56) References Cited

U.S. PATENT DOCUMENTS 2,349,488 A * 5/1944 Dement ..... 206/117
2,811,247 A * 10/1957 Stevenson ..... 206/90
3,915,295 A * 10/1975 Morrison ..... 206/91
4,046,252 A * 9/1977 Korby et al. ..... 206/95
4,753,383 A * 6/1988 Focke et al. ..... 229/160.1
4,753,384 A * 6/1988 Focke et al. ..... 229/160.1
4,989,728 A * 2/1991 Neyret et al. ..... 206/91
5,096,057 A * 3/1992 Yoo ..... 206/90
5,575,386 A * 11/1996 Focke et al. ..... 206/264
5,878,875 A * 3/1999 Leong ..... 206/86
6,644,470 B1 * 11/2003 Grayson ..... 206/92
2003/0205487 A1 * 11/2003 Lin ..... 206/86
2005/0040055 A1 * 2/2005 Bagoian ..... 206/242

FOREIGN PATENT DOCUMENTS

FR 2581040 A1 * 10/1986
GB 2046218 A * 11/1980

* cited by examiner

*Primary Examiner*—David T. Fidei
(74) *Attorney, Agent, or Firm*—Intellectual Property Law Group LLP; Otto O. Lee; Juneko Jackson

(57) ABSTRACT

A 2 in 1 packaging utilizing the 'CLICK opening system (FIG. 1) cigarettes packaging and integrated with matches and its striking paper which is placed in the inner part of the packaging, which consists of: the opening of the packaging utilizing the 'click' system (10), the inner parts of the cigarettes packaging (11), the outer parts of the cigarettes packaging (drawing 12), and the matches and its striking paper packaging (13) which form one integrated unit. The opening of the cigarettes packaging utilizes the 'click' system which is made of elastic plastic or metal and the inner part (11) of the cigarettes packaging forms a part which is placed at the inner parts of the outer parts of the cigarettes packaging where evenly gluing is mandatory so that there will be no air pockets. This is to prevent the smell of the matches as well as of the striking paper of the matches and striking paper packaging (13) having effect on the taste and the aroma of the cigarettes.

9 Claims, 5 Drawing Sheets

2-IN-1 CIGARETTES PACKAGING WITH A 'CLICK' OPENING SYSTEM AS CONTAINER FOR ALL KINDS OF CIGARETTES EQUIPPED WITH MATCHES AND STRIKING PAPER

THE MECHANICS OF THE INVENTION

This invention concerns with commonly used cigarettes packaging, particularly the packaging of cigarettes provided with a 'CLICK' system at the opening and underneath is a space provided for matches and its striking paper.

BACKGROUND OF THE INVENTION

The packaging of cigarettes functioning as a wrapping for cigarettes must meet several requirements, among others: handy in its carrying and keeping, reducing or avoiding contamination with the air outside, reducing the effect caused by the heat of the sun or by humidity and convenient when taking it at the time one is going to smoke. So far, most of the packaging are made of card-paper and in the inside the cigarettes still have to be wrapped in aluminum foil in order that the quality of the taste and the aroma of the cigarettes are stable and the outside of the packaging is wrapped in a clear plastic foil.

Up to this moment cigarettes packaging only serves as a wrapping, so people have to reach for a lighter from some other place separated from the cigarettes packaging mentioned when they want to smoke. In the present invention, the cigarettes packaging, the matches and the striking paper are all in one packaging, so that it is not necessary to look for a lighter at a separate place when one wants to light a cigarette, because underneath the packaging there are matches and their striking paper which form one unit. To make it more practical, the number of matches exceeds the number of cigarettes.

SUMMARY OF THE INVENTION

To maintain the taste and aroma of all kinds of cigarettes, the quality of the packaging is a determining factor.

Every time a smoker wants to smoke, he has to get hold of a lighter as so far the cigarettes and the lighters are available separately. In order to make it more handy, a 2 in 1 cigarettes packaging has been invented using a 'click' opening system, which can accommodate all kinds of cigarettes and underneath the packaging, matches and their striking paper are available as one unit without diminishing the function of packaging and it still meets the requirements of the packaging of all kinds of cigarettes explained above.

DETAILED DESCRIPTION OF THE INVENTION

Figure 1:
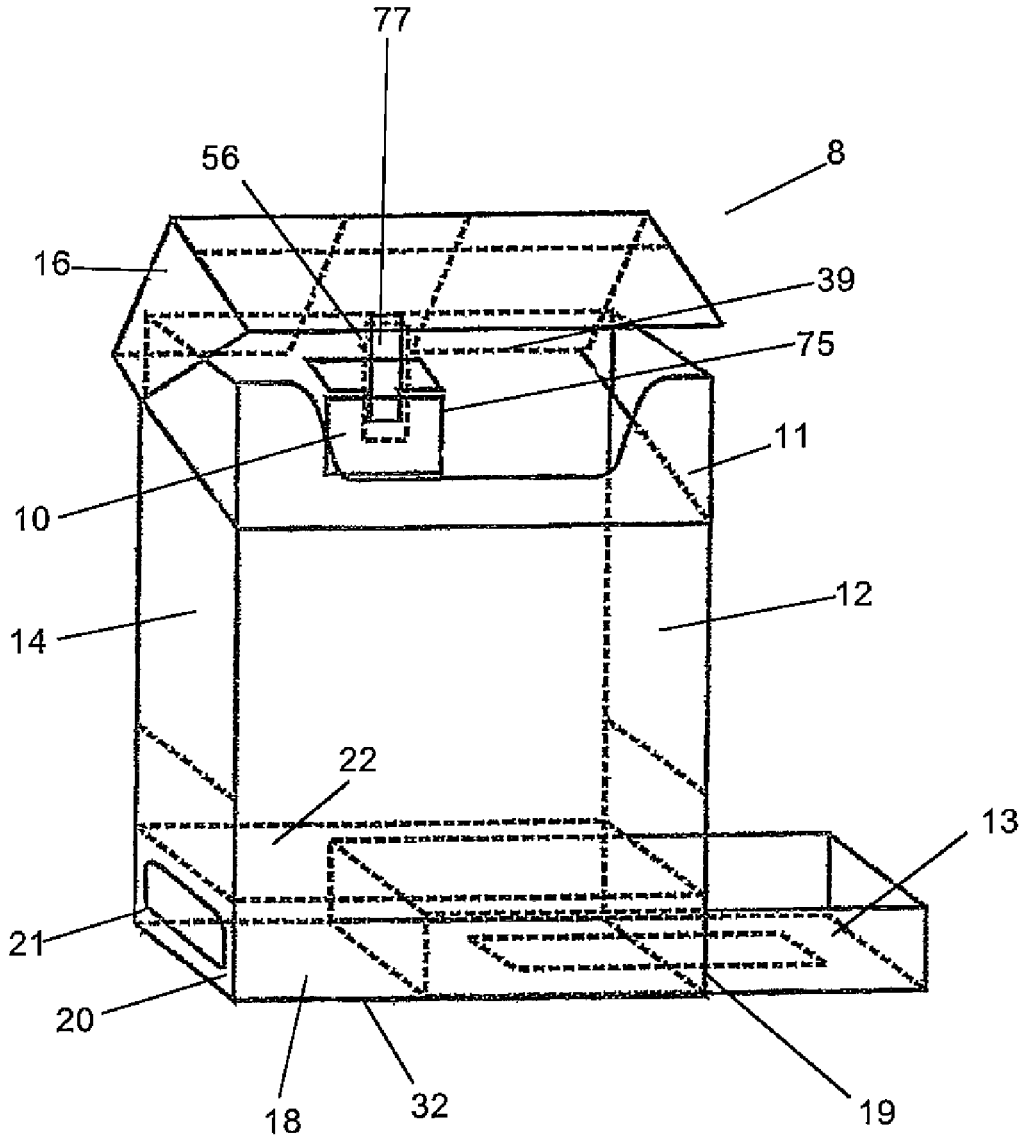
FIG. 1 schematically shows a cigarette packaging according to a preferred embodiment of the present invention.

FIG. 1 shows a package 8 for cigarettes according to a preferred embodiment of the present invention. The package 8 includes an outer portion 12, and inner portion 11, an audible click opening system 10 and a match tray 13.

Generally, the package 8 includes a hollow cigarette receiving portion 14 which is closable by a hinged lid 16. The package 8 also includes a compartment 18 formed below the receiving portion 14. The compartment 18 includes an open end 19, a closed end 20 with a finger slot 21, and an upper wall 22 which is the bottom wall of the inner portion 11 as further explained below.

Figure 2A:
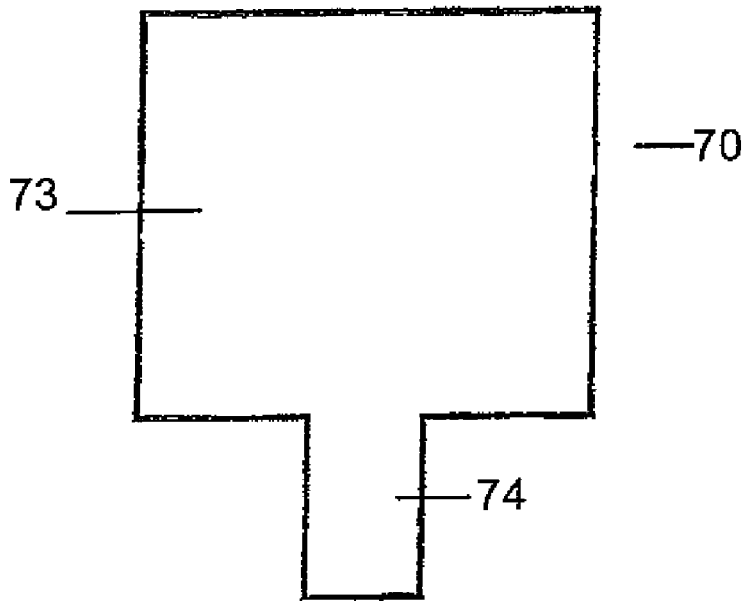
FIG. 2(*a*) and FIG. 2(*b*) show the two parts for the CLICK opening system of the packaging of FIG. 1.
Figure 2B:
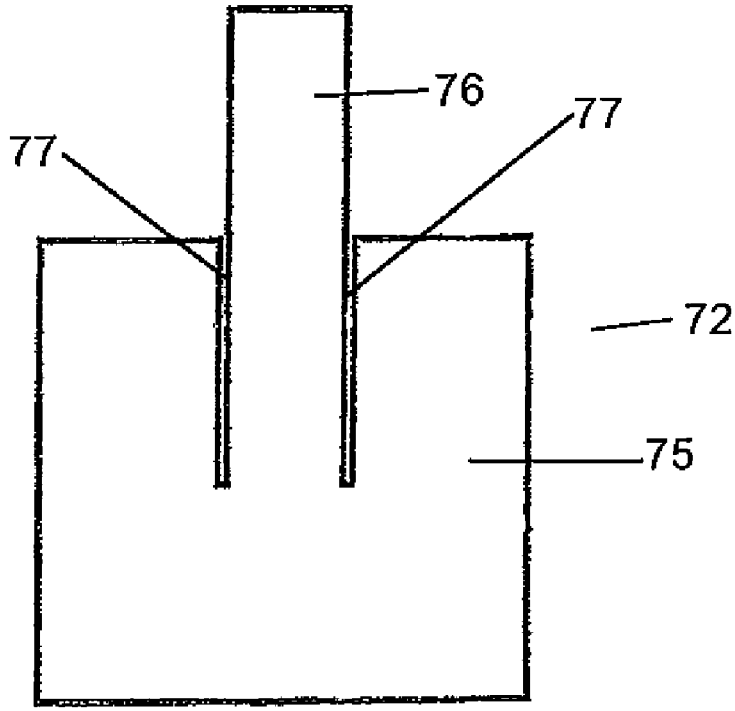

FIGS. 2(*a*) and 2(*b*) show the first and second parts 70 and 72 of the audible click opening system 10 which are made of elastic plastic or metal material. First part 70 includes an attachment portion 73 with an extension 74. Second part 72 includes an attachment portion 75 with a tongue 76 extending therefrom. Cuts 77 are formed on each side of the tongue 76 to allow same to be resiliently movable relative to the attachment portion 75.

Figure 3A:
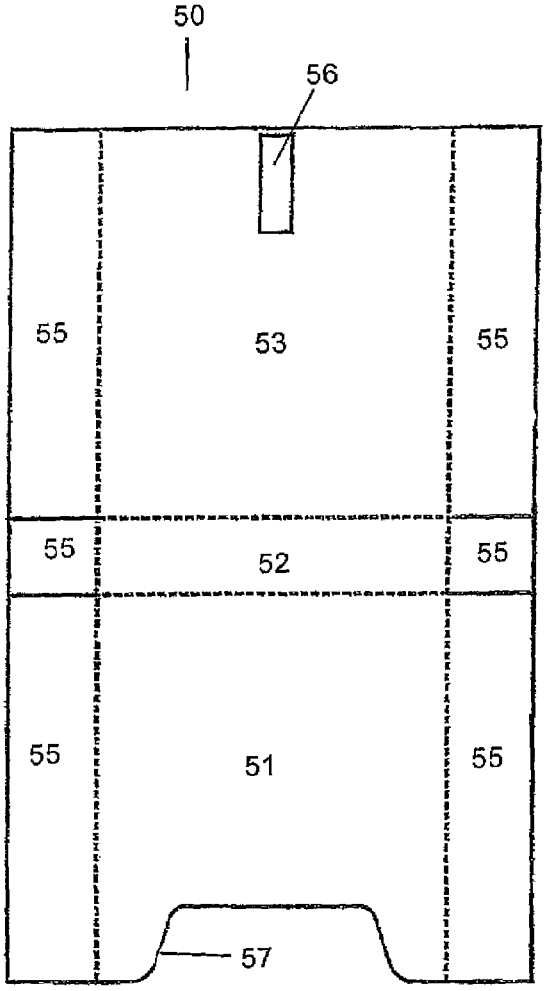
FIG. 3(*a*) shows a folded out blank of the inner portion of the packaging of FIG. 1 and FIG. 3(*b*) shows the assembled folded inner portion.
Figure 3B:
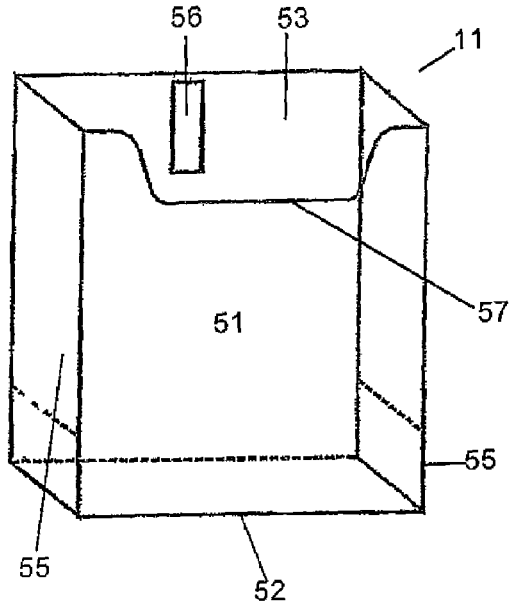

FIG. 3(*a*) shows a blank 50 for the inner portion 11, which includes a front panel 51, bottom panel 52, rear panel 53 and side panels 55. The rear panel 53 includes a slot 56 formed at a top portion thereof and the front panel 51 includes a cutout portion 57 at an edge thereof for access to the cigarettes in the inner portion 11. The blank 50 is folded and glued as is apparent to a skilled person to form the inner portion 11 as shown in FIG. 3(*b*).

Figure 4A:
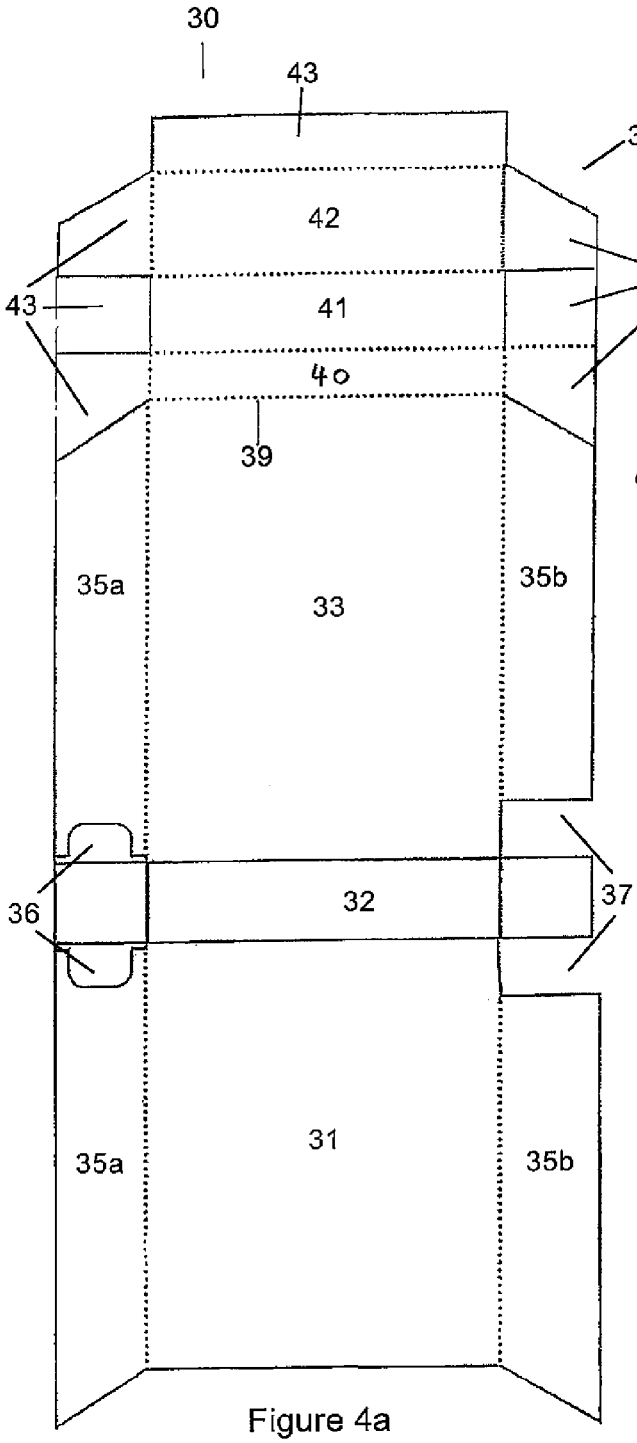
FIG. 4(*a*) shows a folded out blank of the outer portion of the packaging of FIG. 1 and FIG. 4(*b*) shows the assembled folded outer portion.
Figure 4B:
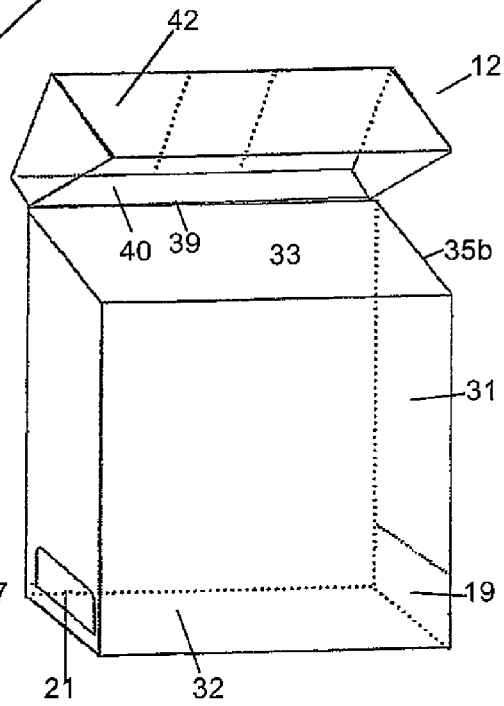

FIG. 4(*a*) shows a blank 30 for the outer portion 12, which includes a front panel 31, bottom panel 32, rear panel 33, hinge panels 34 and side panels 35*a* and 35*b* attached to each side of the front and rear panels 31 and 33. The side panels 35*a* include cutouts 36 for forming the finger slot 21 and the side panels 35*b* include cutouts 37 for forming the open end 19. The hinge panels 34 include a hinge fold line 39, a rear panel 40, a top panel 41, front panel 42 and sides and reinforcement panels 43. The blank 30 is folded and glued as is apparent to a skilled person to form the outer portion 12 as shown in FIG. 4(*b*).

Figure 5A:
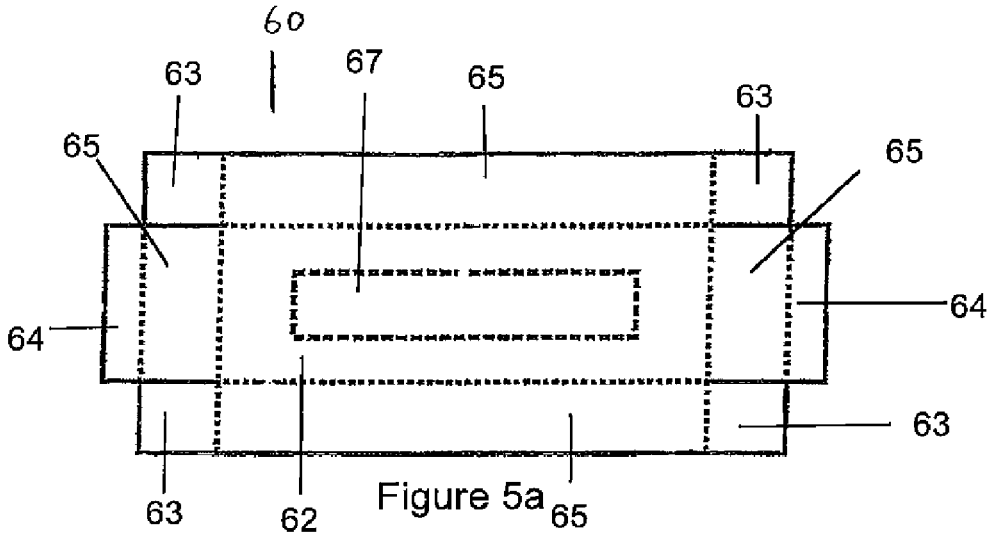
FIG. 5(*a*) shows a folded out blank of the match tray of the packaging of FIG. 1, FIG. 5(*b*) shows the assembled folded tray, and FIG. 5(*c*) shows the striking paper for the tray.
Figure 5B:
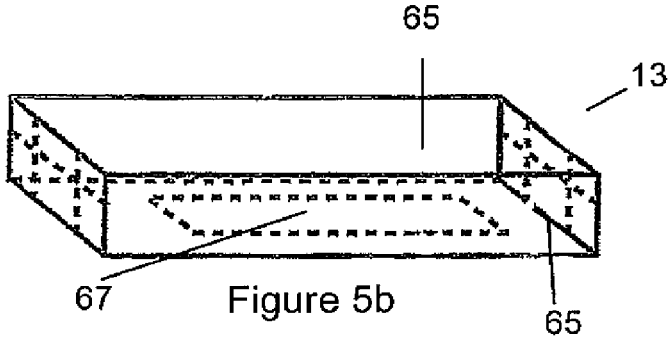
Figure 5C:
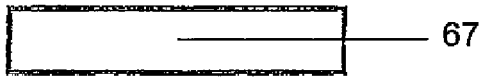

FIG. 5(*a*) shows a blank 60 for the match tray 13, which includes a bottom panel 62, side panels 65, corner panels 63 and reinforcement panels 64. A striking paper 67 as shown in FIG. 5(*c*) is attached to the lower surface of the bottom panel 62. The blank 60 is folded and glued as is apparent to a skilled person to form the match tray 13 as shown in FIG. 5(*b*).

Assembly of the cigarette package 8 will now be described. The opening system 10 is firstly attached to the outer portion 12, by attaching the second part attachment portion 75 to the rear panel 33 below the hinge line 39 with the tongue portion 76 extending upwardly and the first part attachment portion 73 is attached to the hinge panel rear panel 40 with its extension 74 extending downwardly and engaging the tongue 76. The inner portion 11 is then inserted into the outer portion 12 and glued thereto at all sides, with the tongue 77 aligned with the slot 56 of the inner portion 12. The bottom wall 22 of the inner portion 11 is spaced from the bottom wall 32 of the outer portion 12 to form the compartment 18. The match tray 13 is then slidably received within the compartment 18.

The inner portion 11 is attached evenly to the outer portion 11 such that there are substantially no air pockets between them. Thus, the smell of the matches and the striking paper can be substantially excluded and will not have effect on the taste and the aroma of the cigarettes. The striking paper 67 is placed underneath the match tray 13 so that it is covered and protected by the package outer portion bottom panel 52 when the tray 13 is received in the compartment 18. Thus, the striking paper 67 will not stain a user's clothing when kept in the user's pocket and the paper 67 will not get damp when the package is held by sweaty or wet hands. For the opening system 10, in opening of the lid 16, the extension 74 of the first part 70 engages the tongue 76 of the second part 72 causing the tongue 76 to bend inwardly until the lid 16 is opened a sufficient amount that the extension 74 is quickly flipped upwardly against the tongue 76 producing an audible click sound. In closing the lid 16, the extension 74 is flipped downwardly which also produces an audible click sound. The engaging extension 74 and tongue 76 thus also substantially act as resilient springs which can maintain the lid 16 in the opened or closed positions until the lid 16 is moved by the user. Matches are retained in the match tray 13 which is pushed out of the compartment 18 by the user via the finger slot opening 21.

The preceding explanation of the invention is represented for the purpose of illustration and description. It should be understood that what has been explained is not limited to only those mentioned above. The consequence is that all variations and modifications that can be made by the experts upon the 2 in 1 cigarettes packaging using the 'CLICK system as explained above is considered as inclusive in this invention.

What is claimed is:

1. A package for cigarettes, the package comprising:

an outer portion having a hollow receiving portion, which is closable by a hinged lid, the lid being movable between open and closed positions;

an inner portion received within the receiving portion of the outer portion and attached thereto, the inner portion having a cigarette storage portion;

a compartment disposed below the receiving portion; and a match tray having a striking paper disposed at its bottom surface, the match tray being slidably received in the compartment such that the striking paper is covered by a bottom wall of the package when the tray is received within the compartment; and the package includes an audible click opening system comprising a first part having an attachment portion attached to the lid, the first part having an extension extending below a lid hinge when the lid is in the closed position, the opening system further including a second part having an attachment portion attached to a rear panel of the outer portion, the second part having a resilient tongue to be engaged by the extension and produce a click sound in the movement of the lid between its open and closed positions.

2. The package of claim 1 wherein the first and second parts of the opening system are made of elastic plastic or metal material.

3. The package of claims 1 or 2 wherein the inner portion is attached to the outer portion with a space between a plurality of bottom walls thereof thereby defining the compartment between said bottom walls.

4. The package of claims 1 or 2 wherein the compartment includes an open end and a closed end with a finger slot.

5. The package of claim 3 wherein the compartment includes an open end and a closed end with a finger slot.

6. The package of claims 1 or 2 wherein the inner portion is attached to the outer portion such that there are substantially no air pockets between them.

7. The package of claim 3 wherein the inner portion is attached to the outer portion such that there are substantially no air pockets between them.

8. The package of claim 4 wherein the inner portion is attached to the outer portion such that there are substantially no air pockets between them.

9. The package of claim 5 wherein the inner portion is attached to the outer portion such that there are substantially no air pockets between them.

* * * * *